US010473390B2

(12) United States Patent
McCurry et al.

(10) Patent No.: US 10,473,390 B2
(45) Date of Patent: Nov. 12, 2019

(54) MULTI-COMPARTMENT MODULAR COOLER

(71) Applicant: Walmart Apollo, LLC, Bentonville, AR (US)

(72) Inventors: Nicholas Ray McCurry, Bentonville, AR (US); James Rich, Bentonville, AR (US)

(73) Assignee: WALMART APOLLO, LLC, Bentonville, AR (US)

( * ) Notice: Subject to any disclaimer, the term of this patent is extended or adjusted under 35 U.S.C. 154(b) by 123 days.

(21) Appl. No.: 15/712,227

(22) Filed: Sep. 22, 2017

(65) Prior Publication Data

US 2018/0094853 A1 Apr. 5, 2018

Related U.S. Application Data

(60) Provisional application No. 62/404,284, filed on Oct. 5, 2016.

(51) Int. Cl.
*F25D 31/00* (2006.01)
*F24V 30/00* (2018.01)
(Continued)

(52) U.S. Cl.
CPC ..... *F25D 31/005* (2013.01); *F24V 30/00* (2018.05); *F25D 3/06* (2013.01); *F25D 17/04* (2013.01);
(Continued)

(58) Field of Classification Search
CPC ... F25D 3/06; F25D 3/08; F25D 17/04; F25D 23/12; F25D 23/069; F25D 2331/801;
(Continued)

(56) References Cited

U.S. PATENT DOCUMENTS 4,978,023 A 12/1990 Behlmann et al.
5,699,925 A 12/1997 Petruzzi
(Continued)

OTHER PUBLICATIONS

Notice of Allowance in Design U.S. Appl. No. 29/621,300 dated Aug. 8, 2018; 9 pages.
(Continued)

*Primary Examiner* — Joseph F Trpisovsky
(74) *Attorney, Agent, or Firm* — Schmeiser, Olsen & Watts LLP

(57) ABSTRACT

A multi-compartment modular cooler comprising multiple fully enclosed environments, including an insulated cold storage environment, a dry storage environment and an adjustable storage environment that may be either heated or cold storage. The fully enclosed environments may separate into self-contained individual containers. Each of the separate, self-contained enclosures may also recombine into a single unit, simplifying transportation of each section. Connection and disconnection of each section of the cooler may be facilitated by interfacing a plurality of pillars extending from a bottom surface of the upper section into one or more cup holder wells molded into the lid enclosing a lid of the lower section. The depth of the cup holder wells and the length of each pillar being inserted into the cup holder wells may provide significant stability for maintaining the upper section of the multi-compartment cooler in position while connected to the upper section.

18 Claims, 9 Drawing Sheets

(51) Int. Cl.
*F25D 3/06* (2006.01)
*F25D 17/04* (2006.01)
*F25D 23/06* (2006.01)

(52) U.S. Cl.
CPC ..... *F25D 23/069* (2013.01); *F25D 2201/10* (2013.01); *F25D 2400/38* (2013.01)

(58) Field of Classification Search
CPC ..... F25D 2331/804; F25D 2400/14; F25D 2400/16; F25D 2400/38; F24V 30/00
USPC ..... 62/56, 457.1, 457.2, 457.7
See application file for complete search history.

(56) References Cited

U.S. PATENT DOCUMENTS

| | | | | |
|---|---|---|---|---|
| 6,471,059 | B2 * | 10/2002 | Purvis | B65D 81/3813 206/459.1 |
| 6,895,778 | B1 | 5/2005 | Ackerman | |
| 7,122,763 | B1 | 10/2006 | Liu et al. | |
| D674,245 | S | 1/2013 | Williams, Jr. et al. | |
| 8,479,947 | B1 | 7/2013 | Albrecht, II | |
| 8,863,546 | B2 | 10/2014 | Oberweis | |
| 8,925,752 | B2 | 1/2015 | Smith | |
| D732,327 | S | 6/2015 | Ciuksza, Jr. et al. | |
| 9,616,562 | B2 | 4/2017 | Hoppe et al. | |
| 9,976,789 | B2 | 5/2018 | Grepper | |
| 2002/0134090 | A1 * | 9/2002 | Rudick | F25B 9/14 62/6 |
| 2005/0155265 | A1 | 7/2005 | Coleman-Chang | |
| 2005/0263527 | A1 | 12/2005 | Malonado et al. | |
| 2005/0279123 | A1 | 12/2005 | Maldonado et al. | |
| 2005/0279124 | A1 | 12/2005 | Maldonado | |
| 2007/0028642 | A1 | 2/2007 | Glade et al. | |
| 2007/0215425 | A1 | 9/2007 | Slater | |
| 2007/0234615 | A1 | 10/2007 | Pendzich | |
| 2008/0022712 | A1 | 1/2008 | Carr | |
| 2008/0245793 | A1 | 10/2008 | Hanson et al. | |
| 2009/0049860 | A1 | 2/2009 | Manner et al. | |
| 2011/0220531 | A1 | 9/2011 | Meether et al. | |
| 2013/0161143 | A1 | 6/2013 | Kinskey et al. | |
| 2013/0327608 | A1 | 12/2013 | Murdoch et al. | |

OTHER PUBLICATIONS

Examination Report in Canadian Patent Design Application No. 180561 dated Jan. 29, 2019; 2 pages.
International Search Report & Written Opinion in International Patent Application No. PCT/US17/52857, dated Dec. 14, 2018; 11 pages.
"Excursion Picnic Cooler on Wheels," Picnic-Basket.com, accessed Sep. 5, 2016.
"Teikis® 2 Bottles Wine Travel Bag," GreatBartender.com, accessed Sep. 5, 2016.
"TRAILMATE™ 70-qt. Cooler," Walmart.com, accessed Sep. 5, 2016.
"Fashion casual nice looking sports cooler bag on wheels," OEM, LuLuSoSo.com, accessed Sep. 5, 2016.
"Backpack w/Removable Insulated Cooloer Section," KeepYourCooler.com, accessed Sep. 5, 2016.
Greenberg, Julia "The Chemical Reactions that make Hand Warmers Heat Up," Wired.com, Sep. 26, 2014; 3 pages.
International Preliminary Report on Patentability & Written Opinion in International Patent Application No. PCT/US2017/052857, dated Apr. 18, 2019; 9 pages.

* cited by examiner

MULTI-COMPARTMENT MODULAR COOLER

CROSS-REFERENCE TO RELATED APPLICATIONS

This application claims the priority and benefit of U.S. Patent Application No. 62/404,284 entitled "MULTI-COMPARTMENT MODULAR COOLER," filed on Oct. 5, 2016, the contents of which are hereby incorporated by reference.

TECHNICAL FIELD

The present disclosure relates generally to storage container systems and storage apparatuses. More specifically, the disclosure relates to disconnecting and reconnecting modular storage containers having heated, cooled and/or dry storage compartments.

BACKGROUND

Coolers and other storage containers are routinely used for transporting goods from one location to another. Containers used for the transportation of goods may have multiple compartments to store the goods. Often, the goods being transported by the coolers (or other containers), may be perishable or require a controlled environment to maintain the foods at the proper temperature and consistency. Additionally, some coolers may include heating and cooling sources for keeping the items inside a specific compartment at a desired temperature.

Existing technology fails to address the needs for a single, all around container for storing multiple types of consumable goods in several different environments. For instance, existing coolers fail to maintain an ice chest for keeping items cold, a dry storage container for dry items such as plates, napkins and breads from being exposed to moisture and a heated storage compartment to maintain foods within a warmed environment. While heated, cooled and dry storage may be available using multiple separate containers and devices, the current technology lacks a convenient option that encompasses heated, cooled and dry storage within a single apparatus or system.

SUMMARY

A first embodiment of the present disclosure provides a multi-compartment cooler comprising an enclosed first section comprising an insulated storage compartment, wherein the insulated storage compartment maintains a temperature below the temperature of an ambient environment exterior to the insulated storage compartment; a lid connected to the first section, the lid comprising a plurality of indentations, the plurality of indentations are sized to receive a cup; a second section connectable to the lid of the first section; the second section comprising a lower enclosure having a dry storage compartment, an upper enclosure having either a heatable storage compartment or a coolable storage compartment separately accessible from the enclosed dry storage compartment of the lower enclosure, and a plurality of pillars extending from a bottom surface of the lower enclosure, wherein the pillars interconnect with each of the plurality of indentations of the lid.

A second embodiment of the present disclosure provides a method for maintaining separate environments within a multi-compartment cooler comprising the steps of: enclosing a first section of the multi-compartment cooler, the first section comprising an insulated storage compartment and a lid having a plurality of indentations on a top surface of the lid sized for each holding a cup. connecting, to the lid of the first section, a second section comprising a lower enclosure having a dry storage compartment, an upper enclosure having either a heatable storage compartment or a coolable storage compartment separate from the dry storage compartment of the lower enclosure and a plurality of pillars extending from a bottom surface of the lower enclosure fitting into each of the plurality of indentations of the lid.

DETAILED DESCRIPTION

Figure 1:
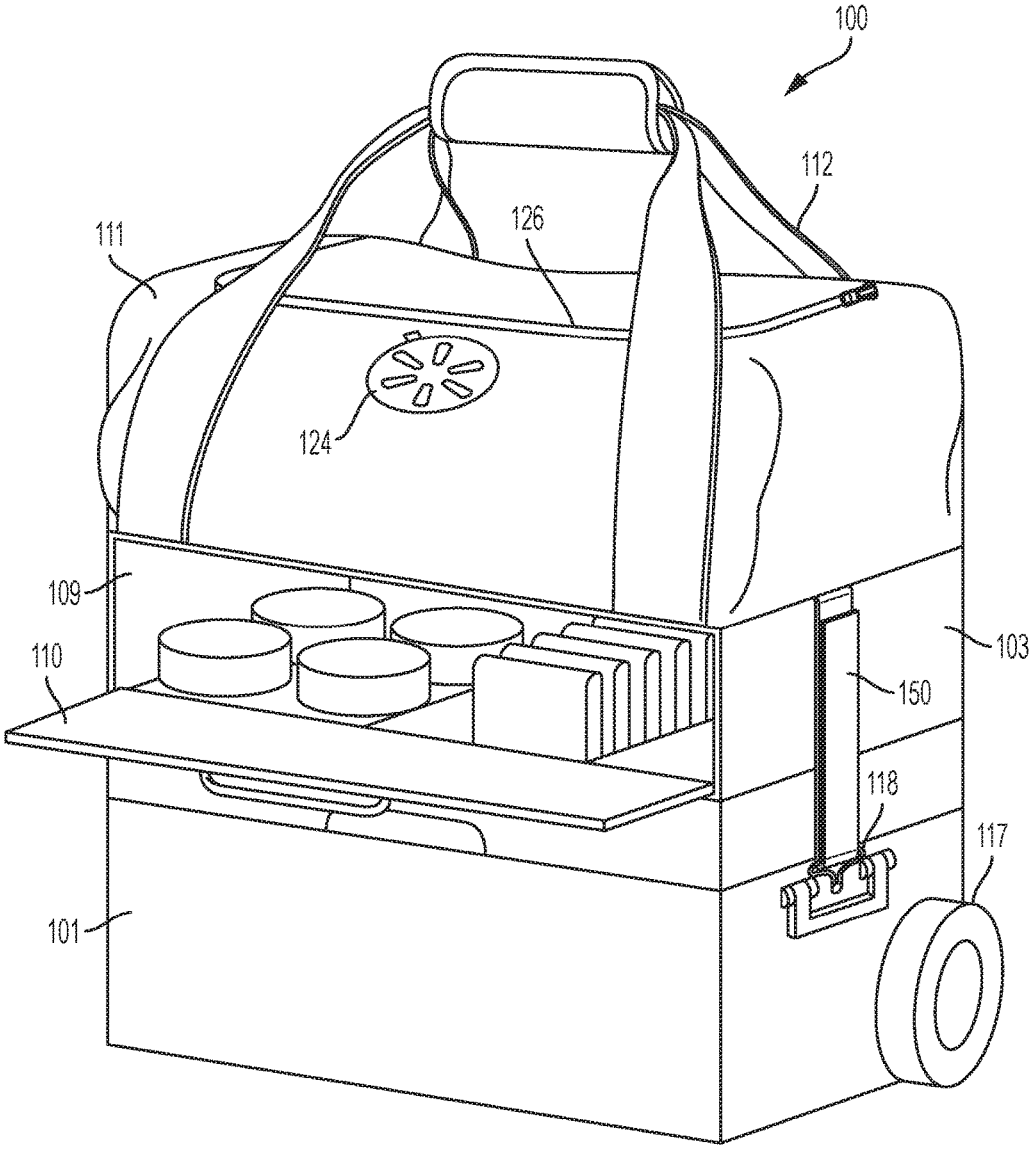
FIG. 1 depicts a front isometric view of an embodiment of a multi-compartment modular cooler.
Figure 2:
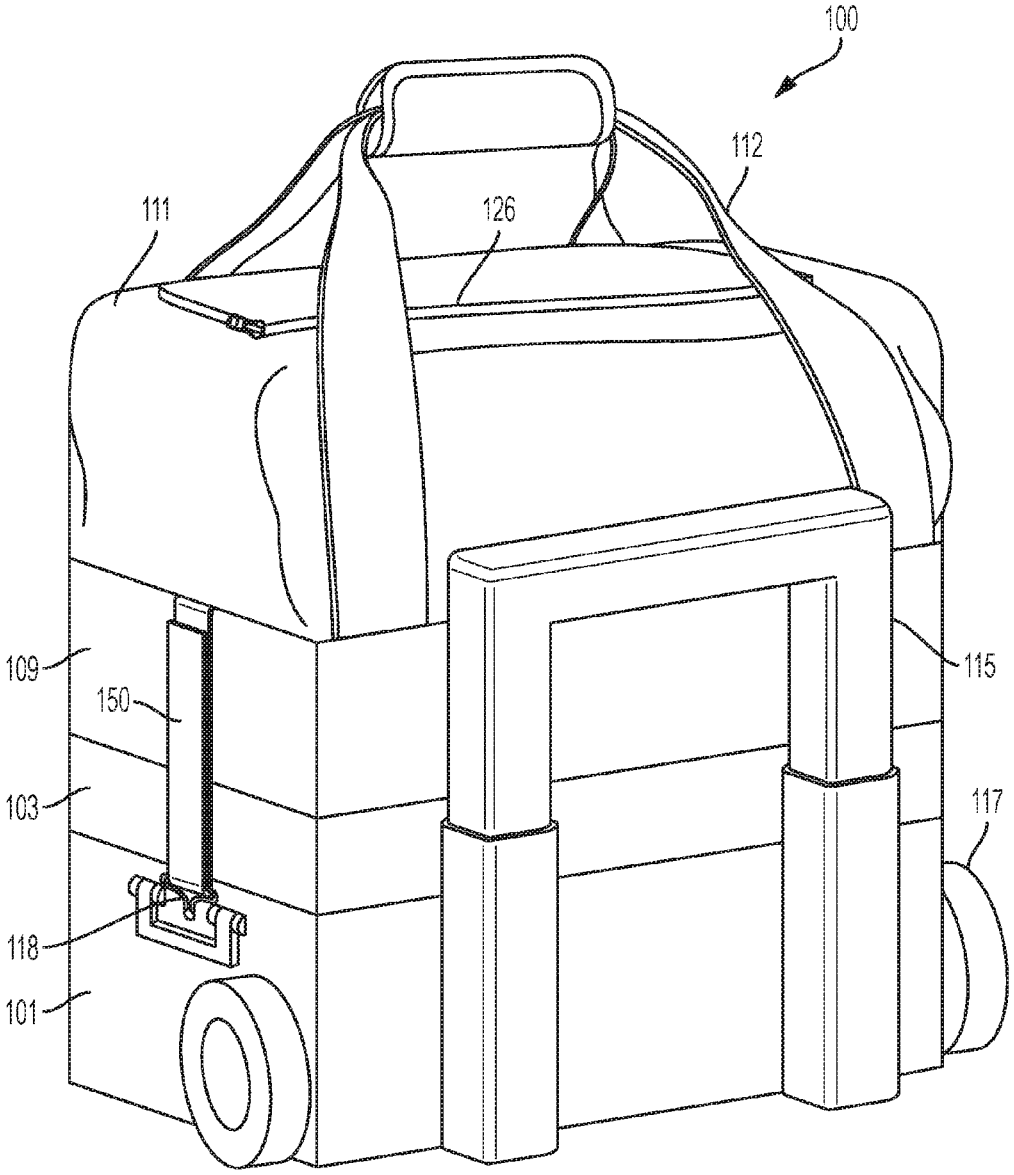
FIG. 2 depicts a rear isometric view of an embodiment of a multi-compartment modular cooler.
Figure 3:
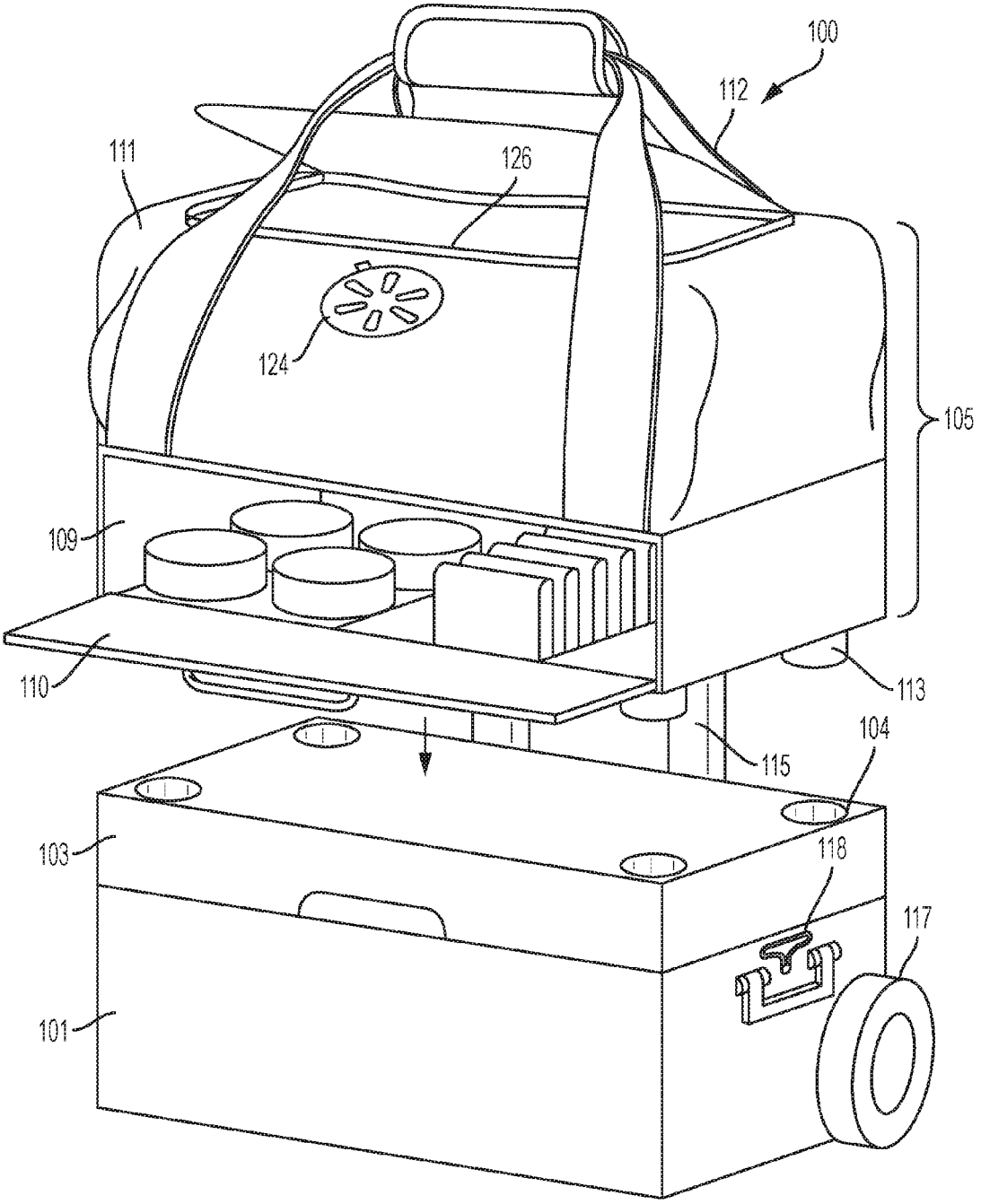
FIG. 3 depicts a front isometric view of an embodiment of a multi-compartment modular cooler separated into multiple sections.

Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure. A more complete understanding of the present embodiments and advantages thereof may be acquired by referring to the following description taken in conjunction with the accompanying drawings, in which like reference numbers indicate like features.

As a preface to the detailed description, it should be noted that, as used in this specification and the appended claims, the singular forms "a", "an" and "the" include plural referents, unless the context clearly dictates otherwise.

Overview

Embodiments of the present disclosure recognize that the apparatuses and methods currently available for maintaining separate environments within a cooler, do not offer three or more different environmental zones within a container that can be transported as a single unit. Currently available containers fail to offer hot, cold and dry environmental zones within fully enclosed compartments that are not influenced by the adjacent environmental zones, nor do currently available coolers offer enclosed environmental zones that are separable and re-combinable for presentation or transportation as needed.

Embodiments of present disclosure improve upon currently available coolers and container systems by offering multiple fully enclosed environments, including an insulated cold storage environment, a dry storage environment and an adjustable storage environment that may be either heated or cold storage. The dry storage compartment may separate the insulated cold storage environment and the adjustable storage environment. The dry storage compartment may act as a buffer in between the insulated cold storage compartment and the adjustable storage compartment, preventing the insulated cold storage or a heated storage compartment of the adjustable storage environment from affecting the remaining storage compartments of the cooler or container.

In some embodiments, each of the fully enclosed environments of multi-compartment cooler may separate into self-contained individual containers. Each of the separate, self-contained enclosures of the multi-compartment cooler may also recombine into a single unit, simplifying the transportation of each section. In some embodiments, the multi-compartment cooler may separate into two sections. The upper section may comprise a fully enclosable dry storage compartment and a second enclosed compartment having an adjustable environment that may be heatable or coolable by inserting a heating device or a cooling device. The upper section of the multi-compartment container may connect and disconnect by interfacing a plurality of pillars extending from a bottom surface of the upper section into one or more cup holder wells molded into a lid enclosing the insulated cold storage compartment of the lower section. The depth of the cup holder wells and the length of each pillar being inserted into the cup holder wells may provide significant stability for maintaining the upper section of the multi-compartment cooler in position while connected to the upper section. However, the upper section may be easily lifted and separated from the lower section using a handle attached to the exterior surface of the adjustable storage compartment.

In some embodiments, the combination of the upper section inserted and connected to the lower section may be easily transported and steered. The lower section of the multi-compartment cooler may be mobilized via a pair of wheels connected to the exterior surface of the insulated storage compartment and an extendable telescopic handle connected to an exterior, rear sidewall. In addition to the telescoping handle and wheels connected the exterior surfaces of the upper and lower sections of the multi-compartment cooler, the exterior surfaces of the may further include a replaceable badge systems that may allow for snap fitting or magnetically attaching identification badges to the exterior surfaces of the multi-compartment cooler.

In some embodiments of the multi-compartment cooler, the adjustable storage compartment of the upper section of the cooler may store an insertable heating container. Embodiments of the insertable heating container may be capable of warming foods stored therein while modulating the moisture content of food held within the heatable enclosure to maintain crispness to the food while simultaneously avoiding the formation of soggy food products. The insertable heating container may include isolated exothermic reactants capable of creating warmth within the insertable heating container instantly, or nearly instantly by exposing the reactants to air or oxygen.

Multi-Compartment Cooler:

Referring to the drawings, FIG. 1 illustrates an embodiment of a multi-compartment cooler 100 (hereinafter "cooler 100"). The cooler 100 may be capable of storing food, beverages, plates, cups, utensils and other products or items, including items for consumption and items aiding in consumption of the stored products and items. Embodiments of the cooler 100 may comprise a plurality of detachable and re-attachable sections. As shown in FIG. 1, the cooler 100 may be divided into an enclosed first section 101 and a separately enclosed second section 105. Although the embodiments in the current application are depicted as a first section 101 and a second section 105, it should be understood by a person skilled in the art that any number of sections may be integrated into the cooler 100 in any of the way described in the current application or known by a person skilled in the art. For example, each of the enclosable sections may be stacked on top of one another using the method of connectivity described herein. Moreover, although the second section 105 (also referred to as an upper section) of the current application combines the dry storage compartment 109 and the adjustable storage compartment 111, in alternative embodiments, the dry storage compartment 109 and the adjustable storage compartment 111 may also be separable and re-combinable with one another.

Each section of the cooler 100 may comprise one or more fully enclosable and re-sealable storage compartments. The term "fully enclosable" when referring to a specific section of the cooler 100, may refer to the specific section of the cooler 100 being surrounded or closed in on all sides. For example by fixed, openable or detachable sidewalls, top surface and/or bottom surface. Embodiments of the enclosures forming each of the storage compartments of each section, described herein may be enclosed independently of another adjacent section or storage compartment. Opening or detaching a portion of one compartment of the cooler 100 may not expose the interior of a separate compartment of a separate section of the cooler 100.

For example, in the exemplary embodiment shown in the drawings, the first section 101 may not utilize the bottom surface of the dry storage compartment 109 to enclose the insulated storage compartment 130 of the first section 101. Instead the dry storage compartment 109 is fully enclosed, independently of the insulated storage compartment 130. The insulated storage compartment 130 has dedicated sidewalls, bottom surface and a lid 103 enclosing the insulated storage compartment 130. In such an embodiment having a fully enclosed dry storage compartment 109 and a fully enclosed insulated storage compartment 130 enclosed by lid 103, allows for separating the dry storage compartment 103 from the second section 105 without exposing the contents stored inside the insulated storage compartment 130.

Embodiments of the cooler 101 may comprise a first section 101, briefly mentioned above. The first section 101 may alternatively be referred to as a lower section in some embodiments, based on the first section's proximal location underneath second section 105 in some embodiments. The first section 101 may be constructed out of any rigid, semi-rigid material and/or insulated material. Materials that may be suitable for constructing the first section 101 of cooler 100 may include plastics, thermoset plastics, thermoset polymers, thermoset polyurethanes, wood, metal, insulated fabrics, paper. Examples of suitable materials may include, but are not limited to hard foams, polystyrene, expanded polystyrene, polyurethane foam, fiberglass, polyisocyanurate, high density polyethylene, medium density polyethylene, linear low density polyethylene, low density polyethylene, polypropylene, polyvinyl chloride, aluminum or aluminum alloys.

The main structure of embodiments of the first section 101 may be constructed by injection molding the suitable materials to form a stiff, rigid and tough exterior casing of the first section 101 and forming the interior sidewalls of the insulated storage compartment 130. Insulated material such as the hard foams, polystyrene, expanded polystyrene, polyurethane foam, etc. may be positioned in between the exterior surfaces of the sidewalls and the interior surfaces forming the insulated storage compartment 130. The insulating material may help to maintain a temperature inside the insulated storage compartment 130, once the insulated storage compartment is fully formed and sealed.

Embodiments of the first section 101 may further comprise an insulated storage compartment 130, fully enclosed and confined by the bottom surface, a plurality of side walls and lid 103 connected to cooler 100. The rigid and insulated materials described above, may be selected by people skilled in the art to maintain an environment within the insulated storage compartment 130 and prevent loss of thermal energy being stored within the insulated storage compartment 130. The materials constructing the first section 101 may be selected based on the properties of the materials for reducing the ingress of warm air from the environment outside of the insulated storage compartment 130 into the inside of the insulated storage compartment 130 or the egress of air colder than the surrounding environment from the insulated storage compartment 130. For example, the insulated storage compartment may comprise an amount of ice, one or more cold packs, refrigeration or other devices capable of reducing the temperature inside the insulated storage compartment to a temperature that is less than a temperature outside of the insulated storage compartment 130. The insulated materials, side walls, lid 103 or base surface of the first section 101 may prevent the loss of the cold air and retain a colder atmosphere inside the insulated storage compartment 130 generated by the temperature reducing devices or refrigerants.

In some embodiments of the first section 101, the lid 103 or the side walls may comprise additional devices for insulating or securing the insulated storage compartment 130. For example, in some embodiments, the lid 103 and the front sidewall of the first section 101 may comprise a latch and a receiver. The latch and receiver, may interconnect or fit together in order to lock and secure the lid 103 to the sidewalls of the first section, in order to prevent the infiltration of warm air or to prevent the escape of cold air from the insulated storage compartment 130. In alternative embodiments, the first section 101 may comprise an additional seal at the interface between the lid 103 and a rim forming the perimeter of the insulated storage compartment 130 by the sidewalls. The seal may be attached to the bottom interior surface of the lid 103, the rim of the insulated storage compartment 130 or a combination thereof. The seal between the lid 103 and the rim may be foam, silicone, vinyl, nylon, rubber, plastic or other material capable of forming a seal and preventing the ingress or egress of gasses, either into the insulated storage compartment 130 or out of the insulated storage compartment 130.

Figure 4:
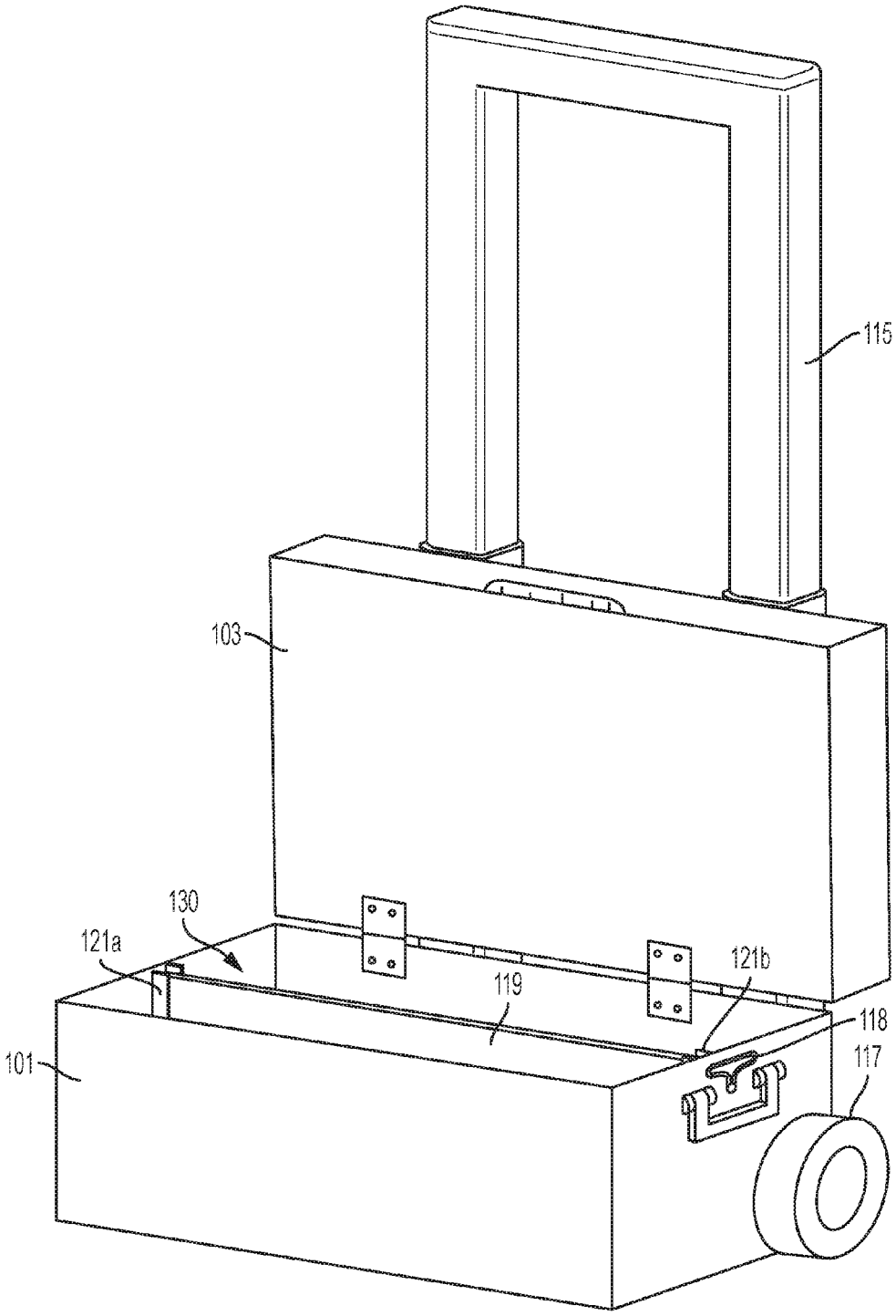
FIG. 4 depicts an isometric view of a first section of a multi-compartment modular cooler.
Figure 5:
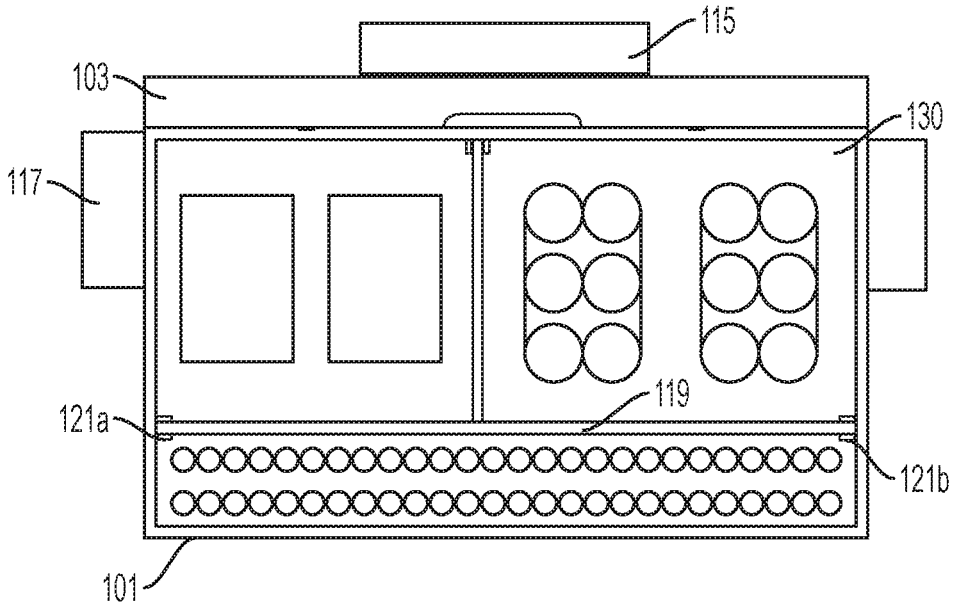
FIG. 5 depicts a top view of a first section of an embodiment of a multi-compartment modular cooler with a lid of the first section in an open position.

In some embodiments of the first section 101, the lid 103 of the cooler may be connected to a sidewall forming the first section 101 in a hinged or pivoting fashion, as depicted in FIG. 4. For example, one side of the lid 103 may remain connected to the side wall, as the front end of the lid 103 rotates upward or downward, thus opening or closing access to the insulated storage compartment 130. In alternative embodiments, instead of the lid 103 pivoting or rotating to open and close access to the insulated storage compartment 130, the lid 103 may be separate from the sidewalls forming the insulated storage compartment 130. The lid 103 may fully separate from the insulated storage compartment 130 and recombine with the first section 101 by being press fitted against the rim of the first section or latched using the latch and receiver system described above. In some alternative embodiments of the first section 101, the first section 101 may not include a lid 103; rather one or more sidewalls forming the first section may act as a door, allowing the sidewall to pivot open and closed to provide access to the insulated storage compartment 130. In some embodiments of the first section 101, the insulated storage compartment 130 may be accessed by a combination of a lid 103 and a removable or openable sidewall. The sidewall access may be advantageous in some embodiments because a user may access the contents of the insulated storage compartment 130 while the first section 101 is combined with the second section 105.

In some embodiments of the first section 101 of cooler 100, the insulated storage compartment may include one or more insertable or removable barriers 119 (hereinafter "barrier 119"). Each barrier 119 may be constructed out of a similar rigid or insulated material as the first section 101 of the cooler 100. However, in the exemplary embodiment the barrier 119 may be constructed out of a material that allows for the rapid transfer thermal energy. For example, to allow for the cold air to permeate evenly throughout the insulated storage compartment 130 and reduce the temperature in each of the sections divided by barrier 119. The barrier 119 may be useful for dividing the insulated storage compartment 130 into subsections, allowing for items or products being stored therein to be further organized or separated. For instance, the barriers 119 may divide the insulated storage compartment 130 into a section for retaining ice or cooling devices separately from the items or products being cooled inside the insulated storage compartment 130.

Embodiments of the barriers 119 may be held in place by one or more sleeves, tracks or retention grooves 121*a*, 121*b* (hereinafter referred to collectively as the "track 121") which may be affixed to one or more sidewalls of the interior surfaces of the insulated storage compartment 119. The track 121 may form a vertical channel that may run along one or more sidewalls. The spacing of each channel formed by the track 121 may be sized in a manner that is wide enough to fit the width of the barrier in between each side of the track 121. A user may position the edge of each desired barrier 119 being inserted into the insulated storage compartment 130, at the point of the track 121 where the channel begins and slide the barrier downward into the insulated storage compartment 130. The barrier 119 may be held in place by each of the track 121 vertically running along the side walls, as the barrier slides down the track 121 into position, touching the bottom surface of the insulated storage compartment 130.

Embodiments of the first section 101 may include a system for increasing the mobility of the entire cooler 100. In the exemplary embodiment depicted in the figures, the first section 101 of the cooler may comprise a set of wheels 117 attached to the exterior surface side walls forming the insulated storage compartment 130. Although on the set of wheels are depicted as being on the left and right side of the first section 101, such an orientation of the set of wheels 117 is not required. The set of wheels 117 may include more than the two wheels depicted by the drawings and the position of the wheels may vary from embodiment to embodiment. For example, in one embodiment, the set of wheels 117 may be integrated into the bottom exterior surface of the first section 101. In alternative embodiments, the wheels may be attached to a front or rear sidewall, or evenly distributed on each side wall or bottom exterior surface using fully rotatable wheels similar to those wheels used for a shopping cart. In some embodiments, the wheels 117 may be rollers, bearings or other devices capable of decreasing the amount of force needed to move the cooler 100 from one point to another.

In some embodiments of the cooler 100, the first section 101 of the cooler 100 may include a handle 115 connected or affixed to a sidewall forming the insulated storage compartment 130. The handle 115 may allow for a user to more easily control the direction of steering and handling of the cooler 100 during transportation. The handle 115 may be a fixed length and position in some embodiments. The length of the handle may vary depending on the size of the cooler 100. In the exemplary embodiment, the handle 115 may be a sufficient length to allow for gripping the handle 115 and maneuvering the cooler 100 while the cooler is fully assembled into a single unit. In alternative embodiments, the handle 115 may be extendable, moveable and/or repositionable. In the exemplary embodiment of the cooler 100, the handle 115 attached to the first section 101 may be a telescopic handle 115, capable of extending and/or contracting in length.

Embodiments of the lid 103, described above, may further include one or more indentations 104, which may be molded into lid 103. In some embodiments, the indentations 104 may be a circular shape and sized to fit a cup within the indentations 104, operatively functioning as a built in cup holder. As shown by the embodiments illustrated in the figures, the indentations 104 may be spread out over the top surface of the lid 103. The depth of the indentations 104 may vary from embodiment to embodiment. In some embodiments, the indentations 104 may have a large circumference and/or deep indentation, whereas in alternative embodiments, the indentations 104 may have a narrower circumference and/or a shallower depth.

In some embodiments, the cooler may include a second section 105, comprising one or more storage compartments that are separately enclosed and distinct from the insulated storage compartment 130 of the first section 101. Embodiments of the second section 105 of the cooler 100 may connect and disconnect from the first section 101. For example, in the exemplary embodiment shown in the figures, the cup holder indentations 104 may operate as a plurality of connection points between the first section 101 and the section of the cooler 100. In some embodiments, the second section 105 may include a plurality of pillars 113 extending from the bottom surface of the second section 105. Embodiments of the pillars 113 may be both sized and positioned to mate with the cup holder indentations 104 of the first section 101. The pillars 113 may be an integrated piece of the second section 105 and may be formed during a molding process of the bottom surface of the dry storage compartment 109. In alternative embodiments, the plurality of pillars 113 may be separately attached, affixed or adhered to the bottom exterior surface of the dry storage compartment 109.

Embodiments of the second section 105 may combine with the first section 101 by aligning each of the pillars 113 above each respective indentation 104 of lid 103. Once aligned, the second section 105 may be lowered, allowing for each of the pillars 113 to mate with each respective indentation 104. The depth and shape of the indentations 104 may provide stability for the cooler 100 while the first section 101 and the second section 105 are combined together. A deeper indentation 104 and a longer pillar 113 mating together may allow for a stronger and more stable connection between the first section 101 and the second section 105. In some embodiments, the materials lining the indentations or the materials coating the outer surface of the pillars 113 may provide additional stability. For example, in some embodiments, the pillars 113 and/or the interior surface of the indentations may be coated with a material that provides an additional amount of friction for securing the pillar 113 together with the indentations 104. Suitable materials that may increase the friction and thus the stability of the connection between the pillars 113 and the indentations 104 may include rubber, silicone, vinyl, latex, foam, polyurethane and other non-slip materials that may increase the grip between of the indentation 104 mated around each pillar 113.

Embodiments of the second section 105 may operate independently from the first section 101. Compartments of the second section 105 may maintain separately enclosed and controlled environments inside one or more fully enclosed compartments while still being able to connect and/or disconnect from the first section 101 as desired by the user. The interconnection between the indentations 104 of the first section 101 and the pillars 113 of the second section 105 may improve the transportability of the cooler 100, allowing the cooler 100 to be moved as a single connected unit, while still being able to separate and move each section to a desired position upon arriving at a selected destination.

In some embodiments, the cooler 100 may include additional means for connecting or securing the second section 105 to the first section 101. For instance, as shown in FIG. 1, the cooler 100 may utilize a strap 150 and anchor 118 system for tightening and securing each section of the cooler 100 together. The strap 150 may be affixed, connected or adhered the exterior surface on each side of the dry storage compartment 109 or the exterior surface of the adjustable storage compartment 111. The strap 150 may be extended downward toward anchor 118, fed through an eyelet of anchor 118 and reattached or tied together with the remainder of the strap. In the exemplary embodiment shown in the accompanying figures, the strap 150 may be a Velcro®, hook and loop or other type of self-adhering strap 150 that may detach and re-attach to itself. After passing the self-adhering strap 150 through the eyelet of anchor 118, the strap 150 may fold back over onto itself and adhere to the first portion of the strap 150. Thus forming a self-connected loop, securing the first section of the cooler 100 to the second section 105.

Embodiments of the second section 105 of the cooler 100 may include a lower enclosure portion comprising a dry storage compartment 109 and an upper enclosure portion comprising an adjustable storage compartment 111. The dry storage compartment 109 may maintain dry environmental conditions which may be free from excess moisture. Additionally, the dry storage compartment 109 may maintain the products or items held therein at a temperature around the temperature of the surrounding environment of the cooler 100. In the exemplary embodiment, the temperature maintained inside the dry storage compartment 109 may be approximately room temperature (22.5° C.).

The materials forming the dry storage compartment 109 may, in some embodiments, be an insulated material, similar to the insulated materials described above for the construction of the first section 101 of the cooler 100. The materials forming the dry storage compartment 109 and the position of the dry storage compartment 109 between the insulated storage compartment 130 and the adjustable storage compartment 111, may reduce, minimize or eliminate the effects of the temperatures inside adjacent storage compartments (insulated storage compartment 130 and adjustable storage compartment 111) on each remaining storage compartment of the cooler 100. Embodiments of the dry storage compartment 109 may act as a buffer between the insulated storage compartment 130 and the adjustable storage compartment 111. For example, the dry storage compartment 109 may minimize or eliminate the presence of ice inside the insulated storage compartment 130 from reducing the temperature of the environment inside the adjustable storage compartment 111. Similarly, the dry storage compartment 109 may minimize or eliminate the effects of a heating device raising the temperature inside the adjustable storage compartment 111 from warming the insulated storage compartment 130, which may be intended to maintain a cold environment.

Embodiments of the dry storage compartment 109 may be constructed out of a plurality of sidewalls connected to one another, a top surface attached to a rim formed by the plurality of sidewalls and a bottom surface attached to the underside of the plurality of sidewalls, forming an enclosure. Embodiments of the top surface of the dry storage compartment 109 may buffer the influence of temperatures inside adjustable storage compartment 111 on other compartments of cooler 100 by creating a barrier between the dry storage compartment 109 and the bottom surface of the adjustable storage compartment 111. The bottom surface of the dry storage compartment 109 may provide material for attaching each of the plurality of pillars 104 to the second section 105 of the cooler as well as create an additional barrier between the dry storage compartment 109, lid 103 and the insulated storage compartment 130. Preventing or minimizing the spread of influence by the temperatures inside the insulated storage compartment 130 on the remaining compartments of cooler 100.

In some embodiments of the cooler 100, the dry storage compartment 109 may include a removable or pivoting door 110 allowing for access to the interior of the dry storage compartment 109. As shown in the figures, the door 110 may be hinged in a manner that allows the door 110 to pivot in an upward, downward or in a swinging manner that may allow for access to the dry storage compartment 109. In some embodiments, the door 110 may fold away from the opening revealing the interior of the dry storage compartment. Additionally, in some embodiments, once the door 110 has been folded in a manner that reveals the interior of the dry storage compartment 109, the door 110 may internalize or be recessed into the dry storage compartment 109 or another section of cooler 100. Embodiments of the door 110 may also be fully removable in some embodiments, similar to lid 103. For example, the door may be retained into position by a force of friction on the door created by the door 110 pressed against the interior top surface, bottom surface and/or sidewalls of the dry storage compartment 109. In such an embodiment, the door 110 (or access panel) may be fully removed from the cooler 100, revealing the interior of the dry storage compartment 109 and subsequently pressed back into place by the user, re-covering the exposed dry storage compartment 109. In alternative embodiments, secondary devices may be used such as a latch, tongue and groove, snap fit or other system for retaining the door 110 in place.

Embodiments of the cooler 100 may further comprise an adjustable storage compartment 111. The adjustable storage compartment 111 may be used as a heated storage compartment or a cold storage compartment. The adjustable storage compartment may utilize a heating device or cooling device to raise or lower the temperature inside the adjustable storage compartment 111. Whether a heating device or cooling device is provided and placed inside the adjustable storage compartment 111 may depend on the types of goods and products are being stored within the adjustable storage device. Warm beverages and foods that may be prepared, served warmed or cooked might be heated inside the adjustable storage compartment 111, by raising the temperature above room temperature or the surrounding environment. Conversely, foods and beverages that may be perishable, refrigerated or preferred to be stored at a temperature cooler than room temperature or the surrounding environment may be stored inside the adjustable storage compartment 111 comprising one or more cooling devices (e.g. ice, ice packs).

The adjustable storage compartment 111 may be connected or affixed to the dry storage compartment 109 in some embodiments, while in alternative embodiments, the adjustable storage compartment may be capable of disconnecting and/or reconnecting to the dry storage compartment 109. In some embodiments, the adjustable storage compartment 111 may be constructed out of a rigid or semi rigid insulated material, similar to the materials used for either the first section 101 or the dry storage compartment 109 as described above. In the exemplary embodiment however, the adjustable storage compartment 111 may be constructed out of an insulated fabric or material. The adjustable storage compartment 111 may have the flexibility and appearance of a bag rather a rigid thermoset plastic container of the first section 101. Types of insulating materials, thermal fabrics and heat retaining liners used for the interior or exterior of the adjustable storage compartment 111 may include, but are not limited to polypropylene, fiberglass, silica or silicate woven fabrics, ceramic fiber cloths, polyethylene terephthalate, polyester, reflective and metalized films, texturized glass filaments, canvas, cotton, nylon, linen, wool, and any other natural or synthetic fabric (either woven or non-woven) that may be capable of being shaped into a storage enclosure and/or capable of insulating the adjustable storage compartment 111.

In some embodiments of cooler 100, the adjustable storage compartment 111 may include an adjustable vent 124. The adjustable vent may be positioned near or within the top surface of the adjustable storage compartment 111. Embodiments of the adjustable vent 124 may be adjusted to the closed position to prevent the loss of thermal energy stored within the adjustable storage compartment 111. For example, when the adjustable storage compartment 111 is desired to be maintained at a colder temperature through the use of a cooling device, the adjustable vent 124 may be positioned in the closed position to prevent the escape of cold air from the adjustable storage compartment. Likewise, in a situation wherein it is desired to maintain the warm air within the adjustable storage compartment 111 the adjustable vent 124 may also be maintained in the closed position. However, in some embodiments, the adjustable vent 124 may be placed in varying degrees of an opened position. By opening the adjustable vent 124, the user may control the amount of moisture maintained within the adjustable storage compartment 111. In some instances, to maintain cooked, prepared or warmed foods from decreasing in desired taste, texture or crispness, the adjustable vent 124 may be opened or modulated to a desired level of openness, to allow for steam and moisture to escape from the adjustable storage compartment 111. Improving the texture and crispness of foods, and preventing the foods inside the adjustable storage compartment 111 from being overly moist and soggy.

The adjustable storage compartment 111 may further include, in some embodiments, a handle 112 affixed to the exterior surface of the adjustable storage compartment. The handle 112 may be a separately distinct handle or graspable piece of material than the handle 115 connected to the first section 101. The handle 112 may allow for the second section 105 to be easily lifted from the first section 101 by applying a lifting force to the second section 101, raising the second section 105 and the pillars 113 from the indentations 104. Embodiments of the handle 112 may allow for the fully enclosed second section 105 to be carried and transported separately from the first section 101, if desired. The handle 112 may be constructed out of the same materials as adjustable storage compartment 111, described above. The handle 112 may be a rigid material, such as a rigidly constructed thermoset plastic, rubber or metal in some embodiments, while in alternative embodiments, the handle 112 may be a semi rigid, fabric material such as linen, nylon, wool, polyester, cotton, a non-woven polyethylene or ceramic fiber.

In some embodiments of the cooler 100, the adjustable storage compartment 111 may house or accept a heating device for increasing the temperature inside the adjustable storage compartment 111. A heating device may be any type of device capable of creating an atmosphere inside the adjustable storage compartment 111 that may increase the temperature inside the adjustable storage compartment to a temperature greater than the ambient temperature outside of the adjustable storage compartment 111. The types of heating devices may include mechanical or chemically activated heating devices such as electrically or chemically activated heating elements, charcoal briskets, heated rocks, heated cloths, heated pads, hot plates, heated bean bags, chemically activated gel packs, and any other type of heat emitting device capable of warming or cooking the contents held within the adjustable storage compartment 111.

Figure 8:
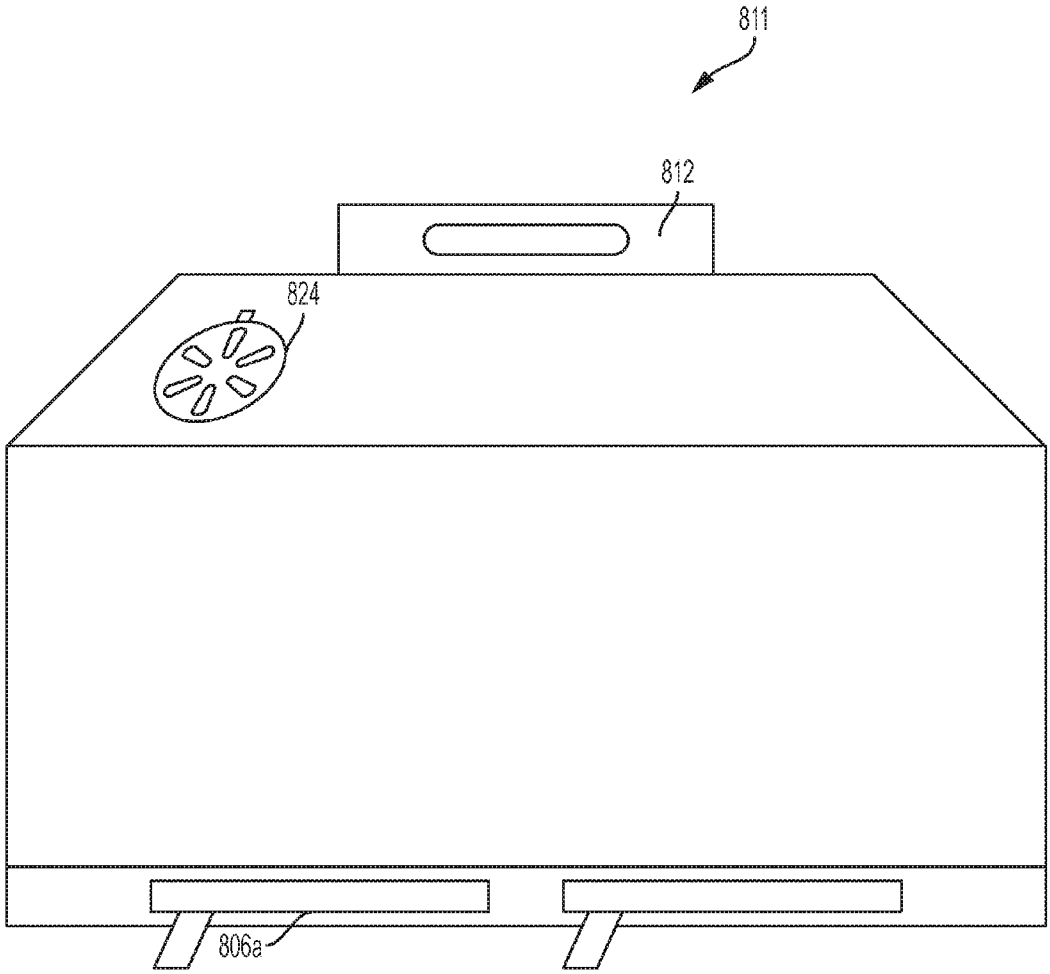
FIG. 8 depicts an embodiment of a non-activated heatable enclosure device.

In one embodiment of the cooler 100, the heating device may be the heatable enclosure device 811 as shown in FIG. 8 of the current application. The opening 126 of the adjustable storage compartment 111 may be expanded and sized to accommodate the insertion of the heatable enclosure device 811. The heatable enclosure device 811 may comprise a separate storage compartment that may line the interior of the adjustable storage compartment 111. Instead of placing the food intended to be heated inside the adjustable storage compartment 111, the heatable enclosure device 811 may be placed inside the adjustable storage compartment 111. The heatable enclosure device may be pre-loaded with food desired to be heated or warmed in some embodiments. In alternative embodiments, the heatable enclosure device 811 may be openable and resealable, allowing for users to insert the food desired to be heated or warmed and resealing the heatable enclosure device 811 to retain the heat inside.

Embodiments of the heatable enclosure device 811 may include a handle 812 allowing for easier transportation of the heatable enclosure device 811 as well as removal from the adjustable storage compartment 111. In some embodiments, the heatable enclosure device may include an adjustable vent 824, similar to the adjustable 124 providing access to the exterior of the adjustable storage compartment 111. Similar to adjustable vent 124, the adjustable vent 824 may modulate and control the retention and release of moisture and steam 826 from the interior of the heatable enclosure device 811. By opening the adjustable vent 824, the heatable enclosure device 811 may release or retain a particular desired level of warmth, while simultaneously removing moisture and steam that can negatively impacts the texture and crispness of the food inside.

Embodiments of the heatable enclosure device 811 may store one or more types of heating fuel that may be selectively activated by a user. The heating fuel stored inside the heatable enclosure device 811 may be shielded or enclosed by the device 811 and a removable pull tab 806*a* or other opening device such as a sliding drawer or removable seal. In some embodiments, the heating fuel may be activated by oxygen or the air. Once the heating fuel is exposed to the air, for example, by moving the pull tab 806*a* or other seal from a closed position to an open position shown by pull tab 806*b*, the exposure to air may perform an exothermic reaction. The exothermic reaction of the heating fuel operating as reactants in the reaction with air or oxygen may generate excess heat as a result of the exothermic reaction, warming the interior of the heatable enclosure device. Examples of heating fuel that may be stored behind a seal such as pull tab 806*a* may include iron oxide, calcium oxide, activated charcoal, sodium chloride, magnesium aluminum silicate, vermiculite, and a combination thereof.

Figure 9:
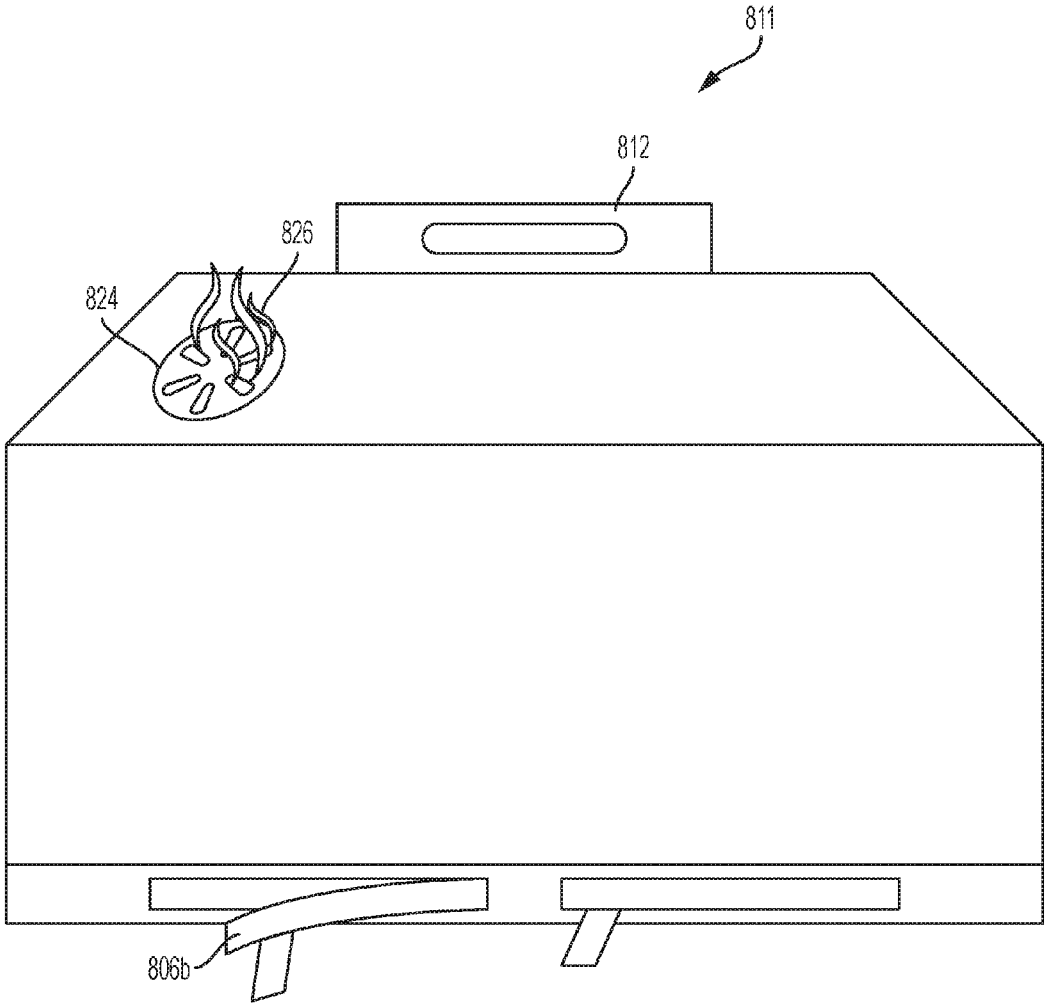
FIG. 9 depicts an embodiment of an activated heatable enclosure device.

In some embodiments, the heatable enclosure device 811 may be refilled with heating fuel and resealed with a new pull tab or other sealing mechanism. In alternative embodiments, the heatable enclosure device 811 may only comprise a limited number of one-time use amounts of heating fuel. Once exposed to the air and the exothermic reaction has completed, it may not be possible to refill the heatable enclosure device 811. However, in some embodiments, the heatable enclosure device 811 may comprise a plurality of pull tabs 806*a*, 806*b* as shown in FIGS. 8 and 9, allowing for multiple uses of the heatable enclosure device 811. Behind each separate pull tab a separate, independent reservoir of heating fuel may be present. For example, in the embodiment shown in FIGS. 8 and 9, there are two separate pull tabs present, wherein behind each pull tab are a separate reservoir of heating fuel.

A user may separately heat the heatable enclosure device 811 on two separate occasions by pulling each tab at different times to initiate two separate exothermic reactions. Alternatively, the amount of warmth generated by the heatable enclosure device 811 may be increased as a function of the number of exothermic reactions occurring simultaneously. For example, by pulling multiple pull tabs 806*a* at the same time or while previous exothermic reactions of another set of heating fuel is occurring, the user can control the amount of heat generated as a function of the number of reactions occurring. The more reactions occurring may result in an increasing temperature inside the compartment of heatable enclosure device 811. Therefore, cooking or warming the food inside to a greater temperature.

Figure 6:
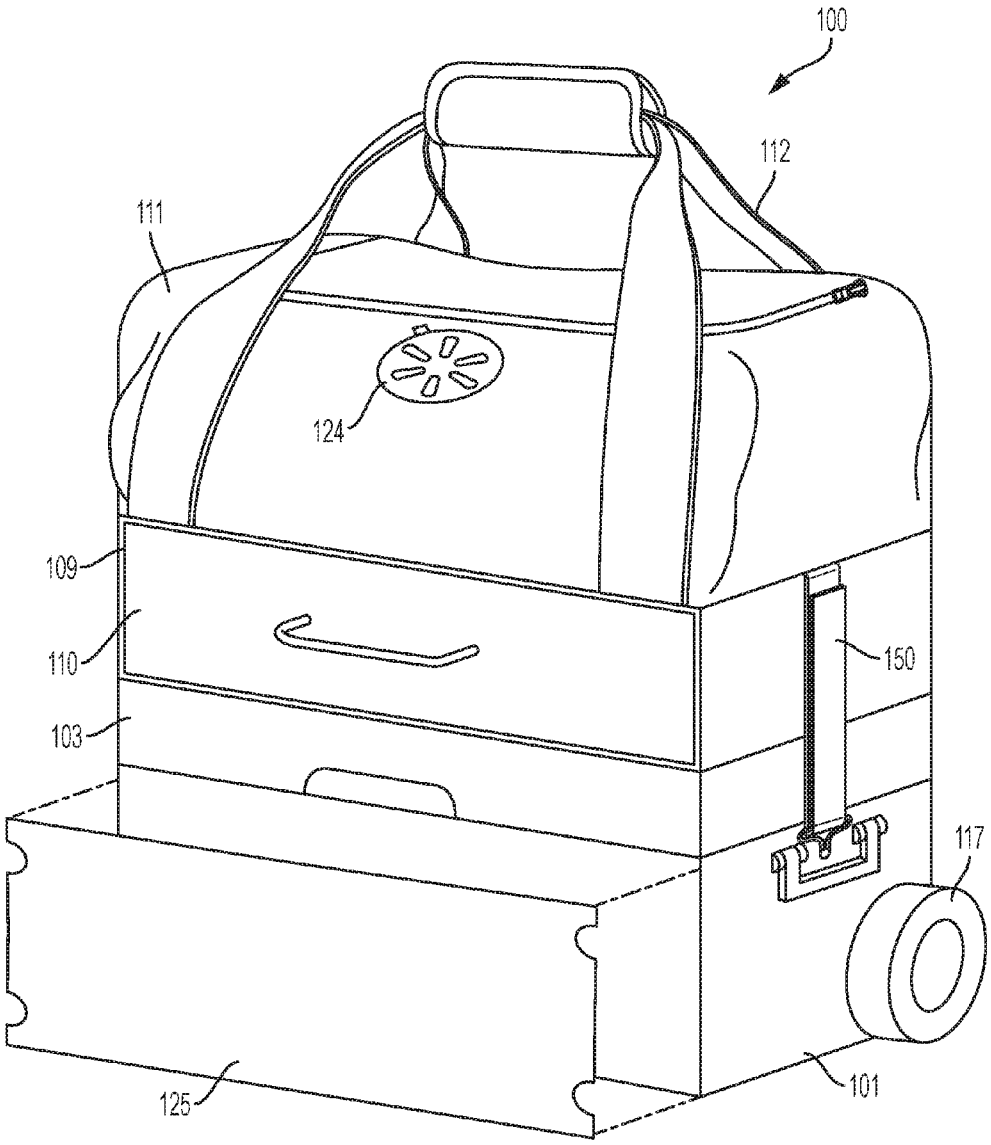
FIG. 6 depicts an isometric view of an alternative embodiment of a multi-compartment modular cooler receiving a removable badge.
Figure 7:
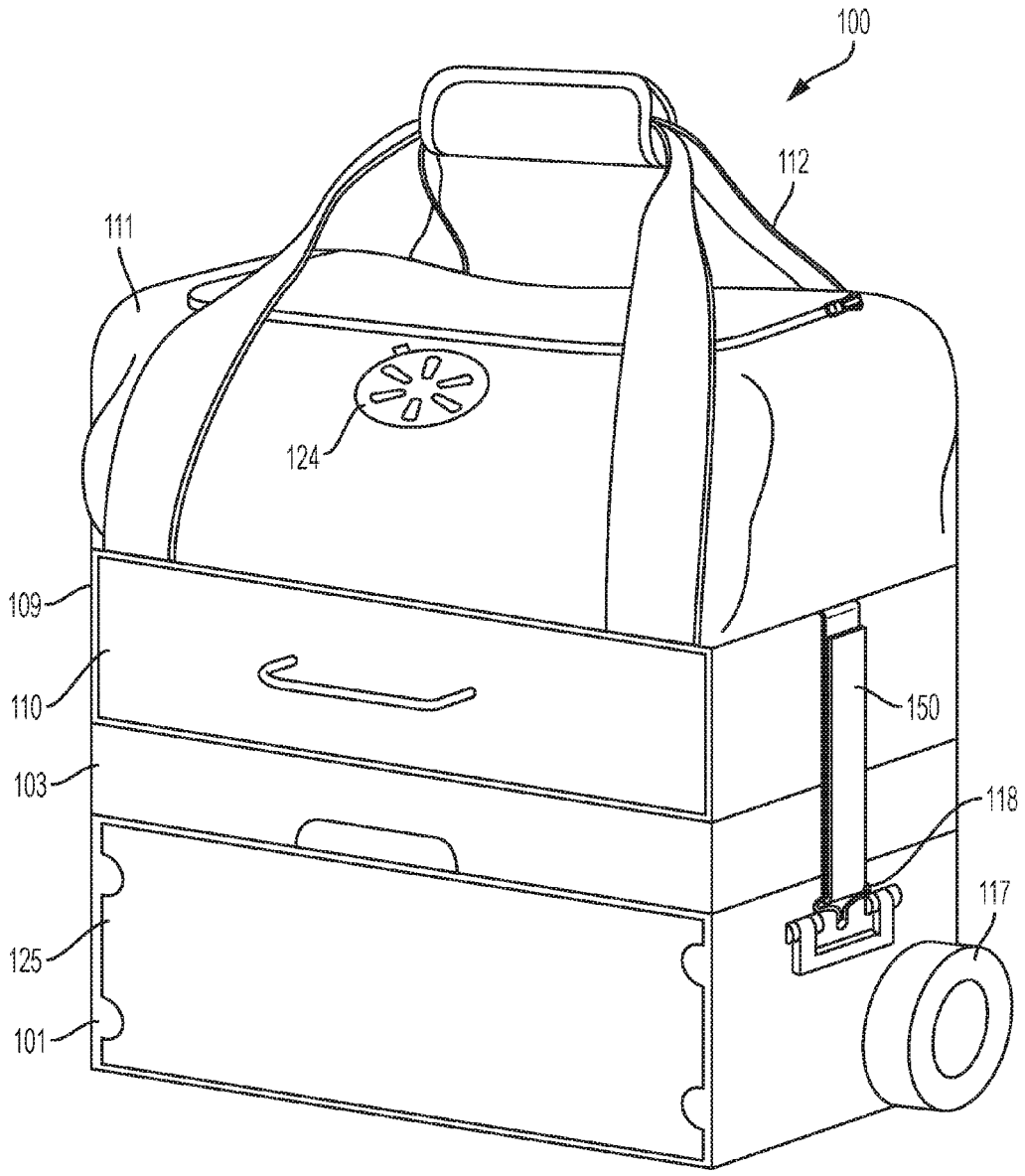
FIG. 7 depicts an isometric view of an alternative embodiment of a multi-compartment modular cooler with a removable bade affixed to a first section.

Additional features of cooler 100 may include, in some embodiments, a detachable, replaceable and re-attachable badging system 125. The badges 125 may be affixed to any exterior surface of cooler 100. For example, the badges 125 may be connected to the exterior surface of first section 101 (as shown in FIGS. 6 and 7), an exterior surface of the dry storage compartment 109, an exterior surface of the adjustable storage compartment 111 or even the exterior surface of a heatable enclosure device 811. The badges 125 may be used for a plurality of purposes. For example, the badges 125 may include particular branding of the cooler's 100 manufacturer or trademark, advertising for products and items, customized designs and plates offering each user to design the cooler 100 with the user's own unique preferences. In some embodiments, the badges may allow for users to write on the badge for example to label the items inside the each compartment or write down cooking instructions. The exterior surface of the badges 125 may be made of a dry erase board material or chalk board coating, allowing for users to label, erase and re-use the surface over and over.

Embodiments of the badges 125 may affix to surfaces of the cooler 100 in any manner known by a person skilled in the art. The badges may be easily removable or re-attachable in some embodiments, for example using magnetic surfaces, screws, snap fittings, hooks, latches, fasteners or other re-attachable devices. In other embodiments, the badges 125 may be more permanently affixed to the cooler 100. For example, using glues, resins, adhesives or etching directly onto the exterior surface of the cooler 100.

Furthermore, in some embodiments, the cooler 100 may further comprise a bottle opener affixed to an exterior surface of the cooler 100. The bottle opener may be shaped in a manner known by a person skilled in the art for the removal of bottle caps from a bottle being opened. In some embodiments, the bottle opener affixed to the cooler may include a collection cup positioned below the bottle opener for catching and holding the removed bottle caps. In alternative embodiments, the bottle opener may be portable and removable from the cooler 100. For example, the cooler may include a pouch or separate compartment for storing a hand-held bottle opener. In some embodiments, the bottle opener may be manually operated, whereas in alternative embodiments, the bottle opener may be electronically operated. Moreover, in some embodiments, the bottle opener may further comprise a manual or electronic corkscrew.

Methods for Maintaining Separate Environments:

Embodiments of methods for maintaining separate environments within a multi-compartment cooler 100 may be performed using one or more of the embodiments of the cooler 100 described above and as pictured in FIGS. 1-9. Although the steps of the method described below are presented in the order described, embodiments of the method may be performed out of order and/or performed before or after the order described below.

In the first step of an embodiment a method for maintaining separate environments in the multi-compartment cooler 100, the method may comprise the step of enclosing a first section 101 of the cooler separate from the remaining sections of the cooler 100. This step may be performed by enclosing an insulated storage compartment 130 having a plurality of sidewalls and a lid 103 comprising a plurality of indentations 104. Inside the insulated storage compartment 130, one or more removable barriers 119 may further divide the insulated storage compartment 130.

In the next step, a second section 105 having a dry storage compartment 109 and an adjustable storage compartment 111 may be connected to the lid 103 of the first section. The step of connecting the second section 105 to the lid may be performed by aligning one or more pillars 113 protruding from the bottom surface of the second section, and inserting each pillar 113 into a corresponding indentation 104 of lid 103. The presence of the insulated lid 103 and/or the presence of the dry storage compartment 109 in between the insulated storage compartment 130 and the adjustable storage compartment 111 may mitigate the effects of heat transfer between the insulated storage compartment 130 and the adjustable storage compartment 111, thus separating the two environments.

In some embodiments of the method for maintaining separate environments within the cooler 100, the temperature of the adjustable storage compartment 111 may be modulated separately from the insulated storage compartment 130. If the adjustable storage compartment 111 is being heated as a heatable storage compartment, the steps performed may include inserting a heating device into the adjustable storage compartment 111 and increasing the temperature of the adjustable storage compartment 111 above room temperature or the surrounding environment that may be exterior to the adjustable storage compartment 111. The step of heating the adjustable storage compartment 111 may occur without increasing the temperature of the insulated storage compartment 130. The lack of impact on the insulated storage compartment 130 may be due to the materials of the lid, dry storage compartment 109 and the distance of separation. In some embodiments, the method may further comprise the step of adjusting a vent 124 of the positioned on the top exterior surface of the adjustable storage compartment 111 being heated. The adjustment of the vent may modulate the moisture within the adjustable storage compartment 111, releasing the moisture and/or retaining the heat within the adjustable storage compartment.

In some embodiments of the method, the step of inserting a heating device may include the steps of inserting a heating enclosure device 811 into the adjustable storage compartment 111. The heating enclosure 811 comprising an exterior body, an adjustable vent 824 positioned on the exterior body, and a plurality of pull tabs 806*a* concealing a heating fuel capable of heating the enclosure 811. In order to heat the heating enclosure 811 within the adjustable storage compartment, the method may further comprise the steps of pulling or more of the plurality of the pull tabs 806*a* and/or unsealing the heating fuel, exposing the heating fuel to air or oxygen, causing an exothermic reaction. As a function of the exothermic reaction, the method may perform the step of increasing the temperature inside the heating enclosure device 811.

In some embodiments of the method for separating the environments of the cooler 100, the adjustable storage compartment may be cooled instead of heated. The steps of cooling the adjustable storage compartment 111 may be performed separately or sequentially with the heating steps described above. The steps of the method may include inserting a cooling device inside the adjustable storage compartment 111, decreasing the temperature with the adjustable storage compartment to a temperature below room temperature and/or to a temperature that is less than the temperature of the environment external to the adjustable storage compartment. The effects of the cooling device placed inside the adjustable storage compartment 111, for example ice, a cold pack, or a chemically activated reactants that, when mixed, perform an endothermic reaction, may reduce the temperature inside the adjustable storage compartment without influencing or causing additional cooling to the insulated storage compartment 130.

In some embodiments the first section 101, the second section 105 and the environments enclosed therein, of the cooler 100 may be physically separated further by detaching each section from one another. Under the disclosed method, the steps for separating the environments of the first section 101 and the second section 105 may be separated by lifting the second section 105 in a direction away from the lid 103 of the first section, without exposing the contents of the insulated storage compartment 130 or the dry storage compartment 109. A user may grasp the handle 112 and apply an upward force in the opposite direction of the first section 101. As a result of applying the upward force, the pillars 113 may separate from the indentations 104, freeing the second section 105 from the first section 101.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed:

1. A multi-compartment cooler comprising:

an enclosed first section comprising an insulated storage compartment, wherein the insulated storage compartment maintains a temperature below the temperature of an ambient environment exterior to the insulated storage compartment;

a lid connected to the first section, the lid comprising a plurality of indentations, wherein the plurality of indentations operate as a cup holder;

a second section connectable to the lid of the first section;

the second section comprising a lower enclosure having a dry storage compartment, an adjustable storage compartment configured as either a heatable storage compartment or a coolable storage compartment separately accessible from the enclosed dry storage compartment of the lower enclosure, and a plurality of pillars extending from a bottom surface of the lower enclosure, wherein the pillars interconnect with each of the plurality of indentations of the lid; and an insertable heating enclosure sized to fit within the adjustable storage compartment;

an adjustable vent on a top surface of the insertable heating enclosure; and a plurality of pull tabs positioned at a base of the insertable heating enclosure, wherein the pull tabs activate a heating fuel.

2. The multi-compartment cooler of claim 1 further comprising:

a pair of wheels connected to the enclosed first section; and a telescopic handle attached to the enclosed first section.

3. The multi-compartment cooler of claim 2, further comprising:

a handle attached to a top exterior surface of the adjustable storage compartment; and the second section is detachable from the enclosed first section.

4. The multi-compartment cooler of claim 1, wherein the adjustable storage compartment is configured as the heatable storage compartment and the adjustable storage compartment further comprises:

a heating device positioned within the heatable storage compartment, said heating device increases a temperature within the heatable storage compartment above room temperature; and an adjustable vent positioned on a top exterior surface of the heatable storage compartment, wherein the adjustable vent modulates an amount of moisture within the heatable storage compartment.

5. The multi-compartment cooler of claim 1, wherein the adjustable storage compartment is configured as coolable storage compartment and an upper enclosure of the second section comprises a cooling device positioned within the coolable storage compartment, said cooling device decreases a temperature within the coolable storage compartment below room temperature.

6. The multi-compartment cooler of claim 1, wherein the enclosed first section is constructed out of a rigid insulated material and an upper enclosure of the second section is constructed out of an insulated fabric.

7. The multi-compartment cooler of claim 1, wherein the insulated storage compartment includes a removable barrier.

8. The multi-compartment cooler of claim 1 further comprising a removable magnetic badge affixed to an exterior surface of the multi-compartment cooler.

9. The multi-compartment cooler of claim 1, wherein the heating fuel activated by the pull tabs is selected from the group consisting of iron oxide, calcium oxide, activated charcoal, sodium chloride, magnesium aluminum silicate, vermiculite, and a combination thereof.

10. A method for maintaining separate environments within a multi-compartment cooler comprising the steps of:

enclosing a first section of the multi-compartment cooler, the first section comprising an insulated storage compartment and a lid having a plurality of indentations on a top surface of the lid sized for each holding a cup;

connecting, to the lid of the first section, a second section comprising a lower enclosure having a dry storage compartment, an adjustable storage compartment operating either as a heatable storage compartment or a coolable storage compartment separate from the dry storage compartment of the lower enclosure and a plurality of pillars extending from a bottom surface of the lower enclosure fitting into each of the plurality of indentations of the lid; and inserting a heating enclosure within the adjustable storage compartment, the heating enclosure comprising an exterior body, an adjustable vent on the exterior body and a plurality of pull tabs for activating a heating device.

11. The method of claim 10, wherein the adjustable storage compartment is operating as the heatable storage compartment and further comprising the steps of:

inserting a heating device into the heatable storage compartment;

increasing a temperature within the heatable storage compartment above room temperature without increasing a temperature within the insulated storage compartment;

adjusting a vent positioned on a top exterior surface of the heatable storage compartment, wherein adjusting the vent modulates an amount of moisture within the heatable storage compartment.

12. The method of claim 10, wherein the adjustable storage compartment is operating as the coolable storage compartment and further comprising the steps of:

inserting a cooling device within the coolable storage compartment; and decreasing a temperature within the coolable storage compartment to a temperature below room temperature.

13. The method of claim 10 further comprising the steps of:

inserting a removable barrier into the insulated storage compartment.

14. The method of claim 10 further comprising the step of:

attaching a removable magnetic badge to an exterior surface of the multi-compartment cooler.

15. The method of claim 10, further comprising the steps of:

pulling one or more of the plurality of pull tabs;

exposing a heating fuel to air, causing an exothermic reaction; and increasing a temperature inside the heating enclosure as a function of the exothermic reaction.

16. The method of claim 15, wherein the heating fuel is selected from the group consisting of iron oxide, calcium oxide, activated charcoal, sodium chloride, magnesium aluminum silicate, vermiculite and a combination thereof.

17. The method of claim 10, wherein the multi-compartment cooler further comprises:

a pair of wheels connected to the first section;

a telescopic handle connected to the first section; and a separate handle attached to a top exterior surface of an upper enclosure.

18. The method of claim 17, further comprising the step of:

lifting and separating the second section from the first section without exposing the insulated storage compartment or the dry storage compartment.

* * * * *